US009605375B2

(12) United States Patent
Frank et al.

(10) Patent No.: US 9,605,375 B2
(45) Date of Patent: Mar. 28, 2017

(54) METHOD FOR TREATING CLOTHES IN A DRYER

(71) Applicant: Whirlpool Corporation, Benton Harbor, MI (US)

(72) Inventors: Michael Frank, Schorndorf (DE); Ralf Haselmeier, Schorndorf (DE); Claudia Schuler, Schorndorf (DE)

(73) Assignee: Whirlpool Corporation, Benton Harbor, MI (US)

( * ) Notice: Subject to any disclaimer, the term of this patent is extended or adjusted under 35 U.S.C. 154(b) by 63 days.

(21) Appl. No.: 14/641,941

(22) Filed: Mar. 9, 2015

(65) Prior Publication Data

US 2015/0259848 A1 Sep. 17, 2015

(30) Foreign Application Priority Data

Mar. 14, 2014 (EP) ..... 14160101

(51) Int. Cl.
*D06F 58/20* (2006.01)
*D06F 58/28* (2006.01)

(52) U.S. Cl.
CPC ..... *D06F 58/28* (2013.01); *D06F 2058/289* (2013.01); *D06F 2058/2864* (2013.01); *D06F 2058/2877* (2013.01)

(58) Field of Classification Search
CPC ..... D06F 58/00; D06F 58/12; D06F 58/20; F26B 21/00; F26B 21/06
USPC ..... 34/497, 595, 610; 68/19, 20
See application file for complete search history.

(56) References Cited

U.S. PATENT DOCUMENTS 2,961,776 A * 11/1960 Hughes ..... D06F 58/28 34/607
3,264,750 A * 8/1966 Berenbaum ..... D06F 58/04 34/546
3,309,783 A * 3/1967 Worst ..... D06F 58/08 34/534
5,555,645 A * 9/1996 Joslin ..... D06F 58/28 34/427
5,771,604 A * 6/1998 Wunderlich ..... D06F 58/02 34/603
7,765,716 B2 * 8/2010 Kim ..... D06F 58/04 134/1
7,946,054 B2 * 5/2011 Dittmer ..... D06F 39/12 165/186
7,992,321 B2 * 8/2011 Ricklefs ..... D06F 58/06 116/67 R
7,992,322 B2 * 8/2011 Kim ..... D06F 58/04 126/85 B (Continued)

FOREIGN PATENT DOCUMENTS

EP 1070165 B1 7/2003
EP 1775368 A1 4/2007

(Continued)

OTHER PUBLICATIONS

European Search Report for Corresponding EP14160101.3, Nov. 4, 2014.

*Primary Examiner* — Stephen M Gravini

(57) ABSTRACT

A method for treating clothes in a dryer, particularly for removing wrinkles from clothes at the end of a clothes drying program or a clothes refreshing program, in which the flow rate of process air circulated in a closed loop is decreased by reversing the rotation of the fan.

24 Claims, 4 Drawing Sheets

(56) References Cited

U.S. PATENT DOCUMENTS

| | | | | |
|---|---|---|---|---|
| 8,015,726 | B2 * | 9/2011 | Carow | D06F 58/28 34/381 |
| 8,104,191 | B2 * | 1/2012 | Ricklefs | D06F 58/203 34/474 |
| 8,276,293 | B2 * | 10/2012 | Ricklefs | D06F 58/203 54/595 |
| 8,434,243 | B2 * | 5/2013 | Kim | D06F 39/005 34/606 |
| 8,806,775 | B2 * | 8/2014 | Kim | D06F 58/28 34/413 |
| 2009/0071032 | A1 * | 3/2009 | Kreutzfeldt | D06F 35/007 34/389 |
| 2009/0255146 | A1 * | 10/2009 | Klug | D06F 25/00 34/491 |
| 2010/0024243 | A1 | 2/2010 | Ricklefs et al. | |
| 2010/0050464 | A1 * | 3/2010 | Krzelowski | D06F 58/203 34/380 |
| 2011/0277334 | A1 * | 11/2011 | Lee | D06F 39/008 34/73 |
| 2015/0259848 | A1 * | 9/2015 | Frank | D06F 58/28 34/425 |

FOREIGN PATENT DOCUMENTS

| | | | | |
|---|---|---|---|---|
| EP | 1852539 | A1 | 11/2007 | |
| EP | 2628846 | A1 | 8/2013 | |
| EP | 2918722 | A1 * | 9/2015 | D06F 58/28 |
| GB | 2051330 | A | 1/1981 | |
| WO | 2010087662 | A2 | 8/2010 | |
| WO | 2011039264 | A1 | 4/2011 | |
| WO | 2013167488 | A2 | 11/2013 | |

* cited by examiner

METHOD FOR TREATING CLOTHES IN A DRYER

CROSS-REFERENCE TO RELATED APPLICATIONS

This application claims the benefit of European Patent Application No. 14160101.3, filed Mar. 14, 2014, which is incorporated herein by reference in its entirety.

BACKGROUND

The present invention relates to a method for treating clothes in a dryer, particularly for removing wrinkles from clothes at the end of a clothes drying program or a clothes refreshing program, the dryer comprising a motor driving a fan and a drum, said fan driving a closed airflow through the rotating drum.

SUMMARY

In a first known type of clothes dryers the electric motor drives not only the rotation of the drum, but also the rotation of fans either for blowing process air in a closed loop through a heater, a drum and a condenser, but also an auxiliary fan for flowing outside cooling air through the condenser.

In a second type of dryers, in which a heat pump system is used, it is not necessary to use the second auxiliary fan since the air from the drum is passed through the evaporator of the heat pump system, therefore acting as a condenser.

In both types of dryers, at the end of the drying cycle the clothes present a very low content of moisture which gives to the user an impression of too dry touch. Moreover the clothes present a high number of wrinkles which make more difficult the subsequent ironing process.

These technical problems have been solved up to now by providing a system for introducing steam or water droplets directly into the drum.

US2010/0050464 discloses a clothes dryer in which a touch-up de-wrinkle sub-program is carried out by supplying steam to the drum by a steam generating device.

WO 2010/087662 A2 discloses a clothes dryer having a cartridge for storing a liquid to be sprayed into the drum by means of a nozzle.

WO 2011/039264 discloses a dryer machine having a desiccant placed in the closed cycle which can be used for releasing moisture for de-wrinkling and humidification purposes.

All the above solutions have the drawback of complicating the manufacture and cost of the clothes dryer, since they need the addition of further components.

The applicant has discovered that in the last phase of the drying cycle, i.e. the cooling phase in which the heater (or the compressor in a heat pump dryer) is switched off, the moisture present in the closed circuit of the process air, particularly in the condenser, is sufficient to increase the moisture content of the clothes when the flow rate of circulating air is reduced, therefore without any further addition of steam or water droplets.

There are known solutions in which the drying cycle comprises a last step in which the air flow is reduced. This is disclosed by EP1775368, even if not expressly in combination with a switched off heater. WO 2013/167488 discloses a dryer in which the drying program comprises a heat-up phase, a semi-stationary drying phase and a cool-down phase. In the cool-down phase the rotating speed of the variable speed motor which drives both the drum and the process air fan is reduced.

The use of a variable speed motor does increase the cost and the complexity of the appliance.

EP 1070165 discloses a dryer in which for the process air circulation is used an air fan with straight-bladed fan wheel so that any inversion of rotation of the motor does not have any influence in the value of the flow rate.

The present invention has the main object to provide a technical solution which not only allows a proper phase for effectively removing wrinkles and increase the soft touching of laundry, but also does not increase the cost and the complexity of the appliance.

The above object is reached thanks to the features listed in the appended claims.

One of the main features of the method according to the invention is to reverse, in the last phase of the drying cycle, the rotation of the motor which drives the drum and the fan, such fan being a centrifugal fan with a fan wheel having bent fan blades and housing with a helical configuration. Therefore the inversion of rotation does not change the rotating speed of the drum bit it reduces the flow rate of air circulating in the closed circuit of the dryer, such reduction being preferably about ⅓ of the normal flow rate. By simply reversing the rotation direction of the motor driving both the drum and the fan blowing air in the closed loop through the drum allows getting a fine warm touching of the clothes and a reduction of wrinkles without the need of using a variable speed motor.

The solution according to the invention may be also used not only at the end of a drying process, but also for a refreshing program in which clothes do not need to be dried, rather to lose bad odors and/or wrinkles.

The invention comprises a humidification phase which can be applied to a standard drying cycle of the standard closed loop system for wet laundry without adding any additional water and which can be also applied to a refresh cycle for dry laundry. For the refresh cycle it is preferable to add water either by spraying water on the laundry or by adding a known device to the laundry in the drum which can hold a predefined amount of water.

The humidification phase according to the invention increases the humidity in the drum and laundry in the final drying phase with the benefits of reducing wrinkles to minimize ironing effort, reducing shrinkage, giving a soft feel and touch of the laundry, reducing odors and refreshing of laundry.

BRIEF DESCRIPTION OF THE DRAWINGS

Further features and advantages of a method according to the invention and of a clothes dryer adapted to carry out such method will be clear from the following detailed solution, provided as a not limiting example, with reference to the attached drawings in which.

DESCRIPTION OF EMBODIMENTS OF THE INVENTION

Figure 1:
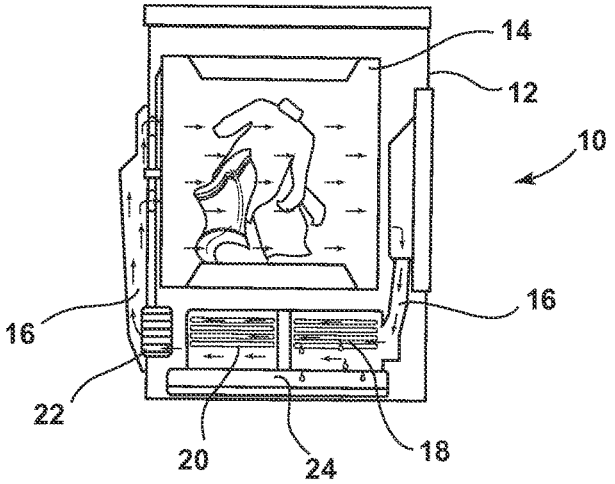
FIG. 1 is a schematic view of a heat-pump dryer in which the method according to the invention is implemented.

With reference to the drawings, a heat pump dryer 10 comprises a cabinet 12 in which a rotating drum 14 is installed. A closed loop air conduit 16 connects the drum 14 to a condenser 18 and to a heater 20, the condenser being an evaporator of a heat pump system (FIG. 7), and the heater being the condenser of the heat pump system. Downstream of the heater 20 and upstream of the drum 14 it is placed in the air conduit 16 a centrifugal fan 22 having a fan wheel with bent fan blades. The drum 14 and the fan 22 are both driven by a single electric motor (not shown) as it is well known in the art. Under the condenser 18 it is placed a tray 24 or sump for collecting condensed water.

Figure 4:
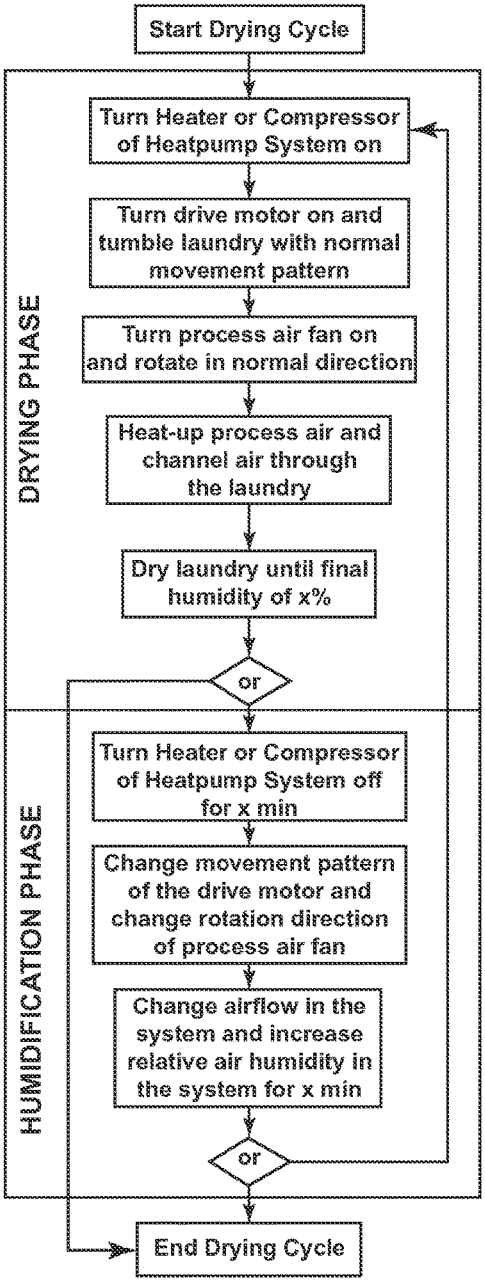
FIGS. 4 and 5 are flow diagrams showing how the method according to the invention is carried out in a clothes dryer either following a clothes drying process or in combination with a clothes refresh cycle.

With reference to FIG. 4, it is shown how a humidification and de-wrinkling phase is carried out after a drying phase in a heat pump dryer or in a condenser dryer. In the drying phase the compressor 36 (FIG. 7) of the heat pump system or the heater of the condenser dryer is switched on until the laundry reaches a predetermined degree of residual humidity. If the user has set a de-wrinkling or humidification process through the dryer user interface, when such humidity threshold is reached the compressor 36 or the heater is switched off and at the same time the rotation direction of the drive motor is changed, so that there is a reduction in the flow rate of process air in the conduit 16 and in the drum 14 due to the asymmetrical design of the fan wheel and to the design of the housing in which such fan 22 rotates (such housing having preferably a helical configuration). By using a centrifugal fan 22 the applicant has tested that by changing the direction of rotation of the motor is possible to reduce the flow rate from one half to one fourth of the flow rate in the other "normal" direction used in the drying cycle. By using fans 22 having diameters comprised between 130 and 180 mm the applicant has obtained a flow rate reduction of about ⅓. With such reduced flow the applicant has discovered that the water droplets still present in the conduit 16 and in the condenser 18 are sufficient to increase the humidity level in the circulation air and therefore in the clothes so that either the wrinkles are reduced and the clothes touching (i.e. the sensation of the user by touching the dried clothes) is improved.

Figure 2:
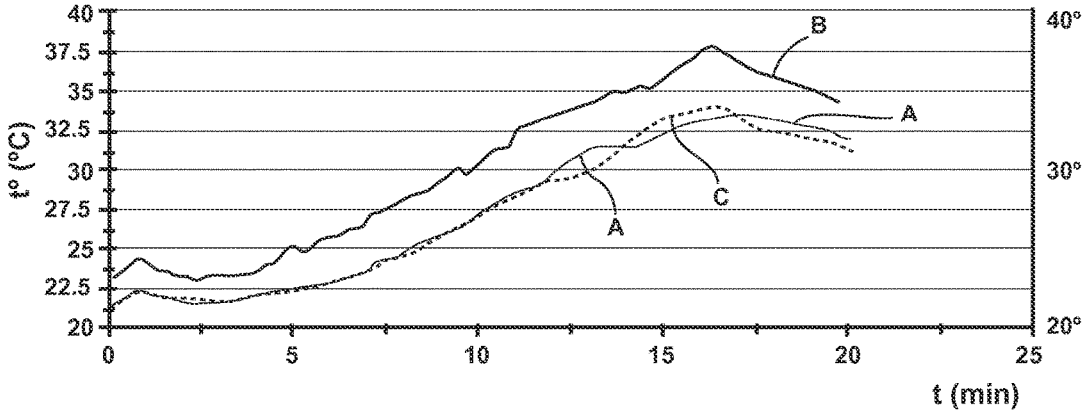
FIGS. 2 and 3 are diagrams showing how the process air temperature and the air humidity change vs. time in the method according to the invention.
Figure 3:
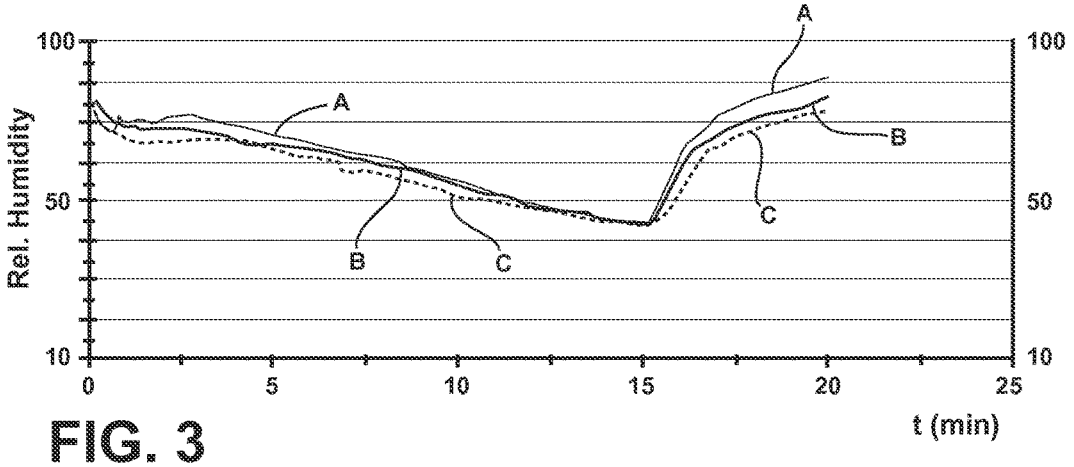

Such practical and quite surprising result in the sudden increase of humidity in changing the direction of rotation of the fan 22 is shown in diagrams of FIGS. 2 and 3. FIG. 2 specifically shows how the process air temperature changes with time during the drying process (from time 0 to about 15 minutes) and during the humidification/de-wrinkling phase (from 15 minutes to 20 minutes) and FIG. 3 shows the relative humidity of air flowing in the conduit 16 and in the drum 14. Both diagrams refer to a heat-pump dryer 10 as shown in FIG. 1, in which the compressor is switched on during the drying process. The three curves of the diagrams refer to different laundry loads (C/P meaning cotton and polyester), as shown in the following table:

| Curve reference | Type of load | Dry load (g) | Air average temperature (° C.) | Impression |
|---|---|---|---|---|
| A | 3 shirts (C/P) + 2 small towels | 598 | 33° | Fine warm and soft touching |
| B | 5 shirts (C/P) + 2 small towels | 1002 | 35° | Fine warm and soft touching |
| C | 7 shirts (C/P) + 2 small towels | 1402 | 33° | Fine warm and soft touching |

Despite the different loads and type of loads, the reduction of air flow rate due to the inversion of rotation direction of the motor when the heating system is switched off allows a sudden increase of air humidity which is responsible either of a de-wrinkling action on clothes and/or of a fine warm touching of the clothes.

Figure 5:
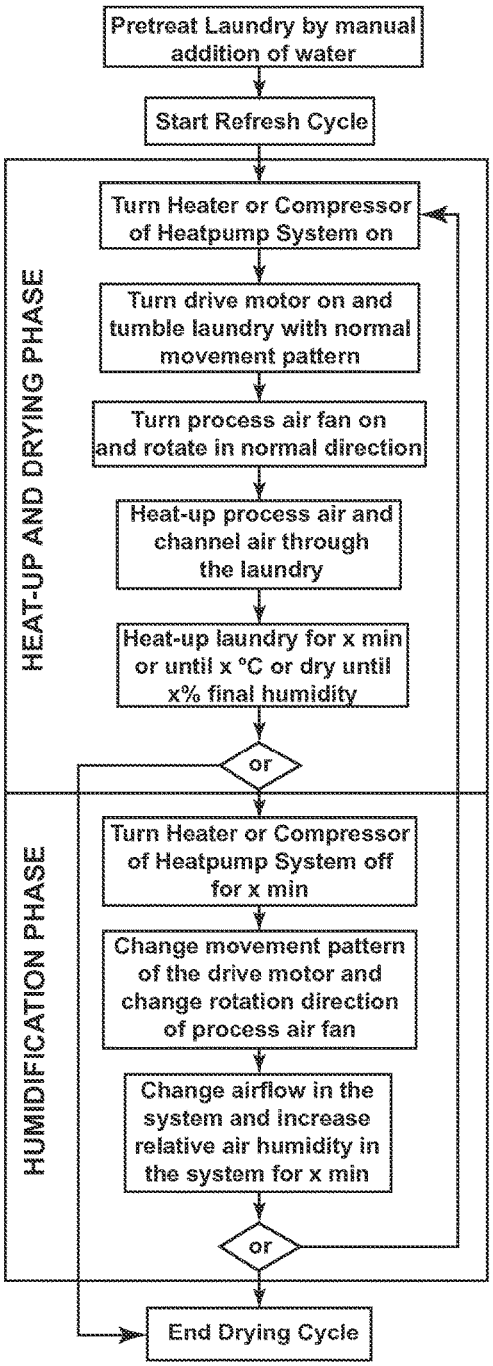

The period in which the heater or the compressor is switched off corresponds preferably to the period of time during which the fan (22) is rotated in a reverse direction. FIG. 5 shows a flow diagram similar to the one of FIG. 4 in which the de-wrinkling humidification phase is carried out at the end of a refresh cycle in which the clothes are pre-treaded by manual addition of water.

Figure 6:
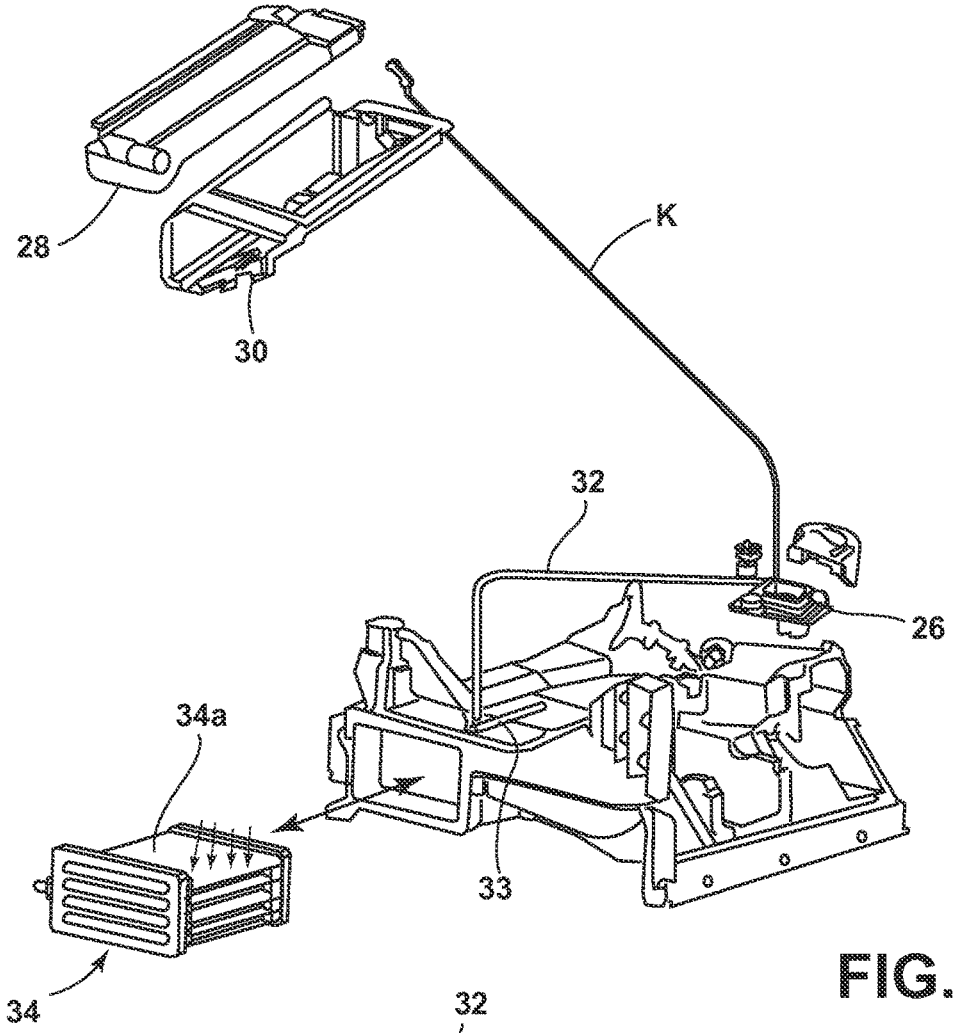
FIG. 6 is a perspective view of relevant components of a condenser clothes dryer according to a further embodiment of the invention.

According to a further embodiment of the invention, the reduced air flow rate assured by inversion of motor direction of rotation may be also exploited by an ad-hoc addition of water on the side of the condenser 18 touched by the process air. With reference to FIG. 6, which shows some components only of a condenser dryer, a water pump 26 normally used for pumping water from the tray 24 to an upper drawer-shaped reservoir 28 sliding in a housing 30 which can be easily withdrawn by the user for manually empting it, can be also used for pumping water though a pipe 32 towards a plurality of water nozzles 33 which spray water on a surface 34*a* of a air/air heat exchanger 24, on the side thereof in contact with the process air. The water flow diversion from a conduit K normally used to deliver water to the reservoir 28 to the pipe 32 towards the condenser 34 is done through a three way valve (not shown) driven by a central process unit (not shown). This has the effect not only of increasing the air humidity (in case the residual humidity is not sufficient to reach a desired level), but also the beneficial effect of cleaning the condenser from fluff, which collects in the tray or sump 24. The intervention of the three way valve and of the pump 26 may be driven by the central process unit when a humidity sensor in the air circuit 16 detects that the air humidity is lower than expected.

Figure 7:
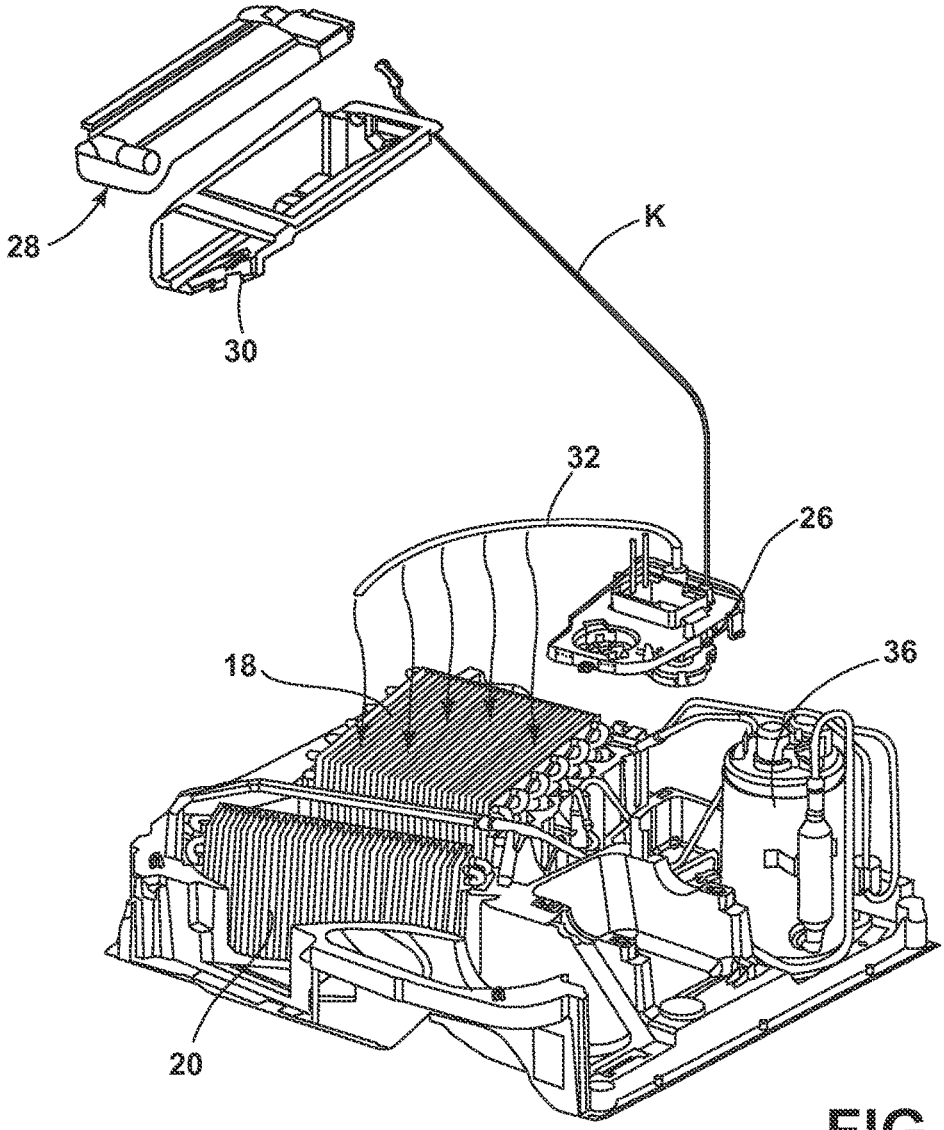
FIG. 7 is a view similar to FIG. 6 but for a heat-pump dryer according to the invention.

In FIG. 7 it is shown a system similar to the one shown in FIG. 6, but for a heat-pump dryer having a compressor 36, an evaporator 18 and a condenser 20. In this case the pump 26 delivers, through the pipe 32, water droplets on the evaporator 18.

Figure 8:
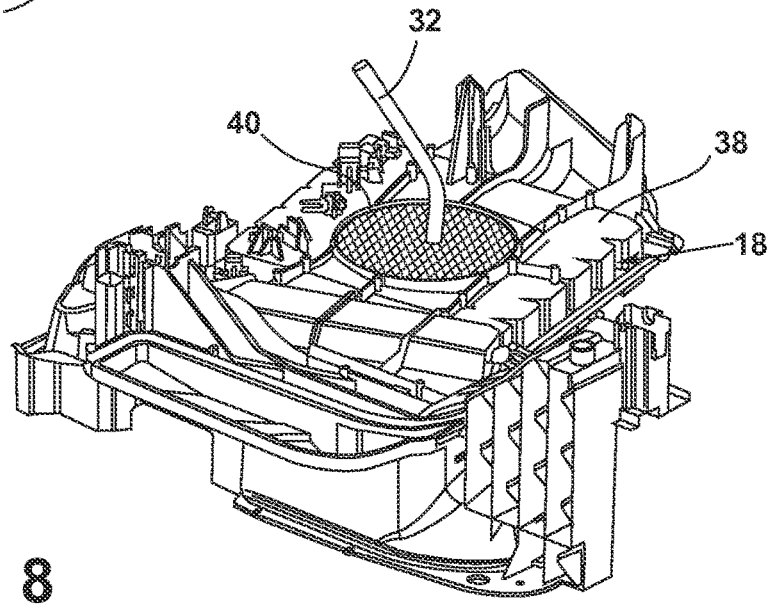
FIG. 8 is a detail of FIG. 7 in a further embodiment of the invention.
Figure 9:
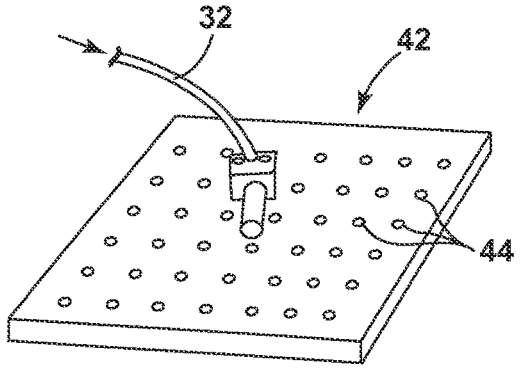
FIG. 9 is a detail of a component to be used in a dryer as shown in FIG. 7.

FIG. 8 shows a detail of FIG. 7 where a cover 38 of the heat pump system comprises a small container 40 with a matrix of holes adapted to deliver a rain of water droplets on the evaporator 18 either for increasing the humidity transfer to the air flow and/or for cleaning purposes. An alternative solution is shown in FIG. 9, where a blow-molded flat plastic container 42 with a plurality of holes 44 is used for the same above purposes.

What is claimed is:

1. A method for treating clothes in a heat-pump dryer comprising a condenser, heater, fan and a drum, fluidly coupled by a conduit, the method comprising:

operating the fan in a first direction to recirculate air through the conduit over the heater and condenser at a first flow rate; and reversing the rotation of the fan by operating the fan in a second direction, opposite the first direction, to recirculate air through the conduit at a second flow rate, which is less than the first flow rate, to decrease the flow rate of airflow recirculated through the conduit.

2. The method according to claim 1, in which the airflow is passing through a condenser and a heater.

3. The method according to claim 2 wherein before the reversing the rotation of the fan, switching off the heater.

4. The method according to claim 3 wherein the heater is switched off for a predetermined period of time corresponding to the period during which the fan is rotated in the second direction.

5. The method according to claim 2, further comprising adding a predetermined amount of water in the condenser.

6. The method according to claim 1, wherein the second air flow rate is within one half and one quarter of the first air flow rate.

7. The method according to claim 6, wherein water is added depending on humidity value of the flowing air.

8. A method for treating clothes in a heat-pump dryer comprising a condenser, heater, fan and a drum, fluidly coupled by a conduit, the method comprising:

during a drying phase, operating the fan in a first direction to recirculate air heated by the heater through the conduit at a first flow rate; and during a humidification phase, after the drying phase, reversing the rotation of the fan by operating the fan in a second direction, opposite the first direction, to recirculate air through the conduit at a second flow rate, which is less than the first flow rate, to decrease the flow rate of airflow through the conduit.

9. The method according to claim 8, in which the airflow is passing through a condenser and a heater.

10. The method according to claim 9, wherein before the reversing the rotation of the fan, switching off the heater.

11. The method according to claim 10, wherein the heater is switched off for a predetermined period of time corresponding to the period during which the fan is rotated in the second direction.

12. The method according to claim 9, further comprising adding a predetermined amount of water in the condenser.

13. The method according to claim 12, wherein water is added depending on humidity value of the flowing air.

14. The method according to claim 8, wherein the second air flow rate is within one half and one quarter of the first air flow rate.

15. The method according to claim 8, wherein the humidification phase comprises recirculating air through the drum.

16. The method according to claim 8, wherein the humidification phase is part of a de-wrinkling phase.

17. The method according to claim 16, wherein the humidification phase comprises transporting moisture deposited in the conduit during the drying phase into the drum.

18. A heat-pump dryer comprising:

a rotating drum;

a closed air conduit system including the drum;

a condenser provided within the closed air conduit system;

a heater provided within the closed air conduit system;

a fan fluidly coupled to and circulating air in the air conduit system; and a control unit operably coupled to and controlling the rotating of the drum, actuation of the heater and actuation of the fan according to a predetermined program, wherein the control unit is adapted to decrease the flow of air in the air conduit system and supply moisture to the drum by reversing the rotation of the fan at the end of a drying program or at the end of a clothes refreshing program.

19. The heat-pump dryer according to claim 18, further comprising a user interface connected to the control unit wherein the user can select a function for removing wrinkles, the reverse rotation of the fan being carried out only when said function is selected.

20. The heat-pump dryer according to claim 19, further comprising a water pump feeding a predetermined amount of water on the condenser.

21. The heat-pump dryer according to claim 20, further comprising a water distributor having a plurality of holes and is in flow communication with the water pump.

22. The heat-pump dryer according to claim 21, wherein the water distributor is a flat container.

23. The heat-pump dryer according to claim 22, wherein the condenser and the heater are, respectively, an evaporator and the condenser of a heat pump system.

24. The heat-pump dryer according to claim 23, wherein the fan is a centrifugal fan.

* * * * *